US005137501A

United States Patent [19]

Mertesdorf

[11] Patent Number: 5,137,501

[45] Date of Patent: Aug. 11, 1992

[54] PROCESS AND DEVICE FOR SUPPORTING FITNESS TRAINING BY MEANS OF MUSIC

[76] Inventor: Frank L. Mertesdorf, Jägerhofstr. 63, D-4330 Mühlheim/Ruhr, Fed. Rep. of Germany

[21] Appl. No.: 445,613

[22] PCT Filed: Jul. 7, 1988

[86] PCT No.: PCT/EP88/00605

§ 371 Date: Jan. 3, 1990

§ 102(e) Date: Jan. 3, 1990

[87] PCT Pub. No.: WO89/00064

PCT Pub. Date: Jan. 12, 1989

[30] Foreign Application Priority Data

Jul. 8, 1987 [DE] Fed. Rep. of Germany ..... 3722468
Sep. 4, 1987 [DE] Fed. Rep. of Germany ..... 3729691
Mar. 5, 1988 [DE] Fed. Rep. of Germany ..... 3807241

[51] Int. Cl.[5] ..... A61H 1/02
[52] U.S. Cl. ..... 482/57; 128/25 B
[58] Field of Search ..... 272/73, 72, 129, DIG. 6, 272/DIG. 9; 128/707, 25 B, 721, 732

[56] References Cited

U.S. PATENT DOCUMENTS 4,378,111 3/1983 Tsuchida et al. ..... 272/73
4,436,097 3/1984 Cunningham ..... 128/707
4,443,008 4/1984 Shimano ..... 272/73
4,512,566 4/1985 Bicocchi ..... 272/72
4,542,897 9/1985 Melton et al. ..... 272/73
4,674,743 6/1987 Hirano .
4,776,323 10/1988 Spector ..... 128/25 B
4,883,067 11/1989 Knispel et al. ..... 128/732

FOREIGN PATENT DOCUMENTS 2114901 6/1982 United Kingdom .

*Primary Examiner*—Richard J. Apley
*Assistant Examiner*—Glenn E. Richman
*Attorney, Agent, or Firm*—Herbert Dubno

[57] ABSTRACT

In a process for supporting fitness training by playing music, in which the exercising person repeats movement cycles periodically, the motivating effect of the music in enhanced in that the music is synchronized by and with the movement cycles and uses a rhythm or a rhythmic beat at a predetermined point within the movement cycle of at least one part of the body of the exercising person. A device for implementing this process includes a pulse generator arranged to correspond to the movement phases of the exercising person during a movement cycle, a synchronization unit which further processes the pulses of the pulse generator, and a device for playing music controlled by the synchronization unit.

11 Claims, 5 Drawing Sheets 35C
35A
35
35C
35A
35
35B
9
9A
35B
13
10
10
8
7
7B
5
36
7A
1
1B
2
6
12A
1A
SENSOR
12
SENSOR
3
4
4
11
34A
30A
30B

PROCESS AND DEVICE FOR SUPPORTING FITNESS TRAINING BY MEANS OF MUSIC

CROSS REFERENCE TO RELATED APPLICATIONS

This application is a national phase application of PCT/EP 88/00605 filed 7 Jul. 1988 and based, in turn, upon German National Applications P 37 22 468 filed 8 Jul. 1987, P 37 29 691.4 filed 4 Sep. 1987 and P 38 07 241.6 filed 5 Mar. 1988 under the International Convention.

FIELD OF THE INVENTION

The invention relates to a process for supporting fitness training by means of music, in which the practicing person repeats movement cycles periodically. The invention also relates to a device for carrying out this process.

BACKGROUND OF THE INVENTION

During fitness training rhythmic movements are performed inter alia. with arms and/or legs, for example by using cycle ergometers or exercise cycles with devices for arm and/or leg movement, during jogging during and training with rowing machines and the like.

Like running, such devices are suitable for the training of endurance fitness, which is an important for maintaining psychophysical well-being and the preservation of the cardio-vascular system. Good training effects are attained with a workload leading to a heart rate of about 70% of the individual maximal heart rate for a time of roughly 20 to 40 minutes. The perceived feelings of exertion and/or boredom often connected with such forms of training result in a dislike for such training.

The perception of discomfort can be reduced by training in time with rhythmic music. While doing so the practicing person adapts the tempo of each movement cycle to the music tempo in such a way that one movement cycle is accompanied by a definite number of musical beats. During such fitness training with musical accompaniment at a preset tempo, the practicing person has to focus a part of his attention on keeping time and, in case of deviation, has to keep adjusting the movement rhythm. This is necessary to attain fully the relieving pacemaker effect of the music and to reduce unpleasant feelings.

In recent years training with rhythmic music has been successfully used to improve motivation for training in "aerobics". Here the exercising person is able to adapt continuously the energy expenditure to his momentary well-being and performance capability by varying the intensity and extent of his movements. An individual variation of energy expenditure with exercise cycles is (with an unchanged load) possible by changing the pedalling rate. With devices that allow a frequency adjustment independents of workload, variations in rotational speed do not lead to variations in necessary effort, but may be felt as a pleasant change. In any case changing the tempo of movement cycles during training accompanied by music at a preset tempo leads to the beat being lost.

From German Patent Document DE-OS-2949 630 it is known that the speed of playing audiovisual presentations can be changed with the pedalling tempo on an exercise cycle, for instance by the use of a small roller sensor rotated by the flywheel. But with this procedure, it is quite impossible to allocate the beginning of prominent rhythm elements of the music or musical beats to phases of the movement cycles of the practicing person.

OBJECTS OF THE INVENTION

It is an object of the invention to provide a method and an apparatus for improving the motivational support of music in such a way that it is not necessary to concentrate on adjusting the movement rhythm to the musical beats of the music.

SUMMARY OF THE INVENTION

With respect to a process the problem is solved in that a) the music is synchronized from and to the movement cycles, and b) a musical and audible beat of the music respectively begins in a predetermined position within each movement cycle of at least one body part of the practicing person.

A simultaneous synchronization of visual display devices to the tempo of movement cycles can further improve the motivating effect.

In an example of the invention music is used in a digital form because the synchronization is thus very simple and by the use of a synthesizer the pitch is not influenced by changes of movement tempo on the part of the exercising person. With regard to a device for carrying out the process. The apparatus can comprise pulse generators assigned to the movement phases of the practicing individual, i.e. the physical movement of a body part, a synchronization unit processing the pulses of the pulse generators, and a device for playing music controlled by the synchronization unit. Advantageously, the pulse generator is circumferentially positioned on the flywheel, on the drive wheel or on the pulse disc of a fitness training device.

The latter can have two handle bars transmitting a force from the handle bars to the flywheel in such manner that the handle bars act on the flywheel via drive bars, oppositely directed crank arms and a cog wheel independently of the foot pedals. The movement frequencies of foot pedals and handle bars can be equal or different.

An arrangement for recognizing the direction of movement of the practicing person or an arrangement for recognizing irregularities during the pulse generation and a correction device are advantageously provided so that the correction device reestablishes the synchronization between the movement and music and the selected onset point of the audible or musical beats, if irregularities occur.

Music can be stored in the form of digital codes mainly for the beginning and end of notes, pitch, velocity, aftertouch, modulation voices, i.e. for the music to be played all note characteristics can be digitally stored. The musical tempo can be varied by means of varying the speed of emitting MIDI-timing clock codes and codes for note characteristics without such variation swing rise to any change in the pitch.

By contrast, compact disk(CD) and digital audio tape(DAT) store music by means of digitalization at a high scanning frequency of the electrical analog mixed signal. Here a change in music tempo changes the pitch.

Compact-disk and digital audio tape can also be used for the music tempo control described below, if there are stored timing clock codes related to measure even if the music tempo was different at the time of recording.

Within the meaning of the invention fitness training is defined as any kind of exercise which maintains or improves the performance and/or health of the practicing person. Music is defined as any kind of rhythmic sound combination as can be found in rhythm machines and also in melodious songs. The musical beat is the metric subdivision of a bar. Its length is determined as a fraction of a whole note. The music tempo is the speed of the musical beats. It is defined by the number of metronome clicks per minute. The time from the beginning of one metronome click up to the beginning of the next usually is a quarter note long. By audible beat in the meaning of the invention is meant a prominent audible event which is repeated in successive musical beats more or less regularly and mainly begins at the onset of a musical beat preferably as part of the rhythm accompaniment. A musical beat can also begin with a constant or varying delay. Audible beats can also be prominent sound patterns which give the impression of being a unit. It is typical that they are periodically repeated in successive musical beats and give the acoustic orientation when one is in time with the music. They can psychically reinforce phases of increased tension and/or accentuated movement in fitness training, which are rhythmically repeated in successive movement cycles.

By means of the invention frequency changes of the movement cycles are possible without the beat being lost, because the music movement tempo is synchronized to the movement tempo. Onset points or phases and the number of audible beats can be predetermined and do not change with the movement tempo, if they are not changed by the exercising person. If an audible beat starts at the beginning of a musical beat or is time delayed constantly, its onset point within a movement cycle can be predetermined or changed by the beginning of the musical beat. In this connection I have discovered that the motivating effect is only pronounced at the onset of the audible beats in definite individually different phases of a movement cycle. An onset of the audible beats within the musical beats, varying in time, could also be taken into account. Generally this is not necessary as this is usually not felt to be unpleasant.

In the following examples it is assumed that rhythmic music is used and the audible beats are periodically repeated within the musical beats. Thus a chosen number of audible beats can be allocated to predetermined phases of a movement cycle of one or several body parts through the allocation of a corresponding number of musical beats. The exercising person in the example is able to select his preferred onset point of musical beats as a criterion. Whether the audible beats start at the beginning of the musical beats or not, is unimportant, since the allocation of audible beats to certain movement phases determines the onset point of the musical beats. In case varying onset positions of the audible beats within different musical beats the practicing person could select an onset position of the musical beats which corresponds to the average onset position of the audible beats within the movement cycle, and imitate time variations of the prominent sound sequences within his movement cycle.

For instance, an integral number of musical beats can be allocated to the movement cycles, which during the usual frequency range of the movement cycles lead to the usual range of music tempi. Two musical beats of a quarter note for every movement cycle—allocated to the same phases of the cycles during their repetition—are generally suitable for training with an exercise cycle and for jogging with the usual range of movement frequencies of 50 to 90/min and usual range of music tempos of rhythmic music For instance a visual display of the frequency of the movement cycles, of the current and total performance and the difference to a preset performance goal can be used to give information about the movement tempo during training in time with a preset tempo.

The components and steps of the process to be used for the invention are not subject to exceptional conditions with reference to their size, shape, selection of materials, technical concept and procedure conditions respectively. Thus the criteria of selection usual in the fields of application can be used without restriction.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
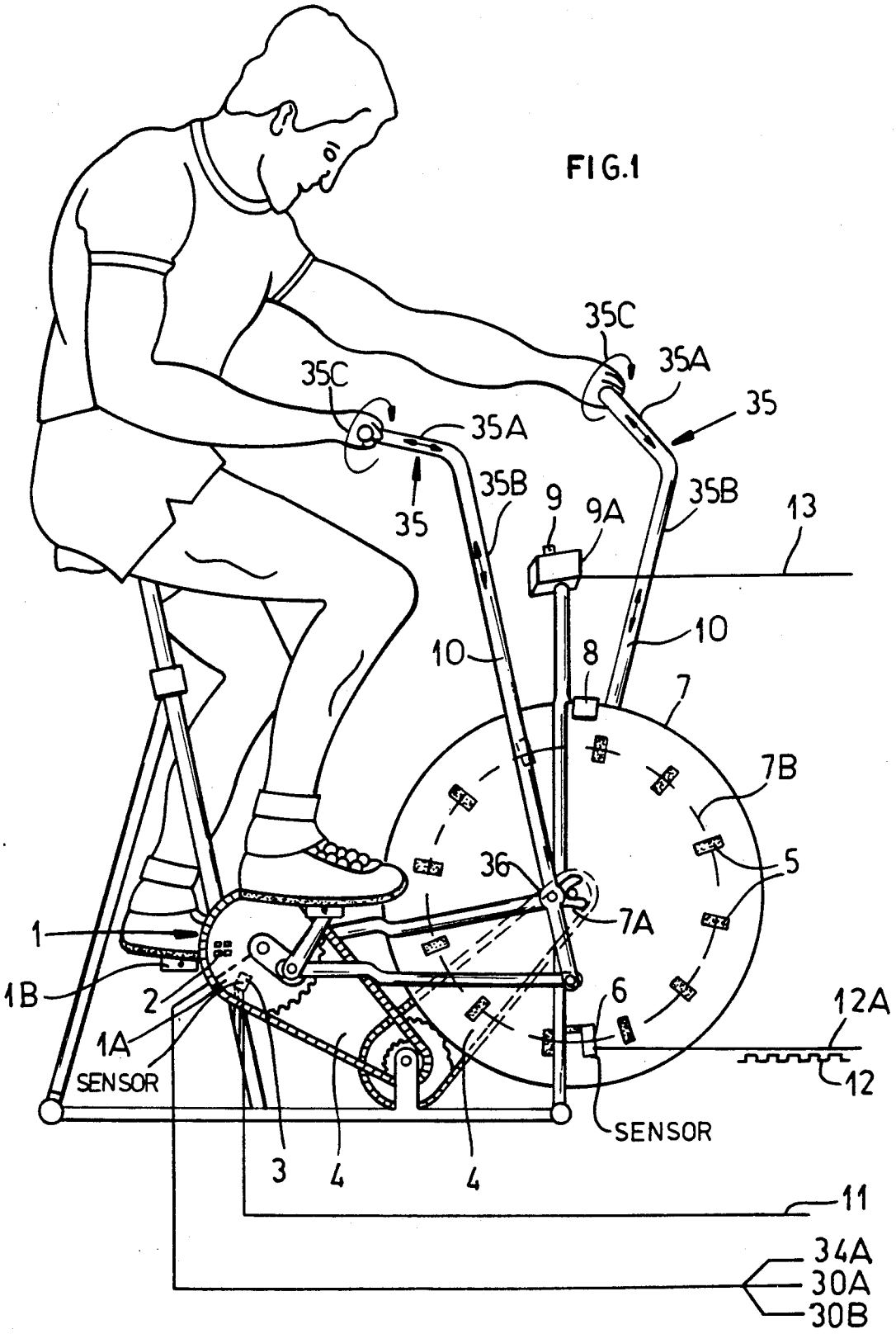
FIG. 1 is a diagrammatic elevational view which illustrates an exercise cycle with pulse generators.

The exercise cycle illustrated in FIG. 1 has a foot pedal crank device 1 and handle bars 10 which can be moved forwards and backwards and are connected eccentrically to its cog-wheel (drive wheel) 1A and drive a flywheel 7 as the unit for energy intake (c.f. German Patent documents 517774, 2742719). The flywheel 7 is mechanically braked at 8. The application of such equipment is especially useful for an exercise supported by music because it allows coordinated rhythmic movement of the arms and legs.

In a first embodiment each pressing down of a foot pedal 1B and simultaneously moving forward of one handle bar 10, moving backward of the other handle bar 10 and moving upwards of the other pedal 1B during this section of a movement cycle—with suitable music—is accompanied by the onset of the audible beat beginning with a musical beat of a quarter note. In such a way the contraction of the muscle groups used for this movement phase, especially the stretching of one leg and one arm and/or the bending of the other arm, are psychically reinforced by the onset of an audible beat of music, especially its rhythm accompaniment.

The opposite coordination in pulling backwards a handle bar 10 and simultaneously treading down the foot pedal 1B on the same side is also felt to be pleasant For the synchronization of the music to the exercise a pedalling rate of about 50 to 80 revolutions per minute is recommended. This frequency level is comfortable for most people and allows for the beginning of a musical beat of a quarter note while the leg is being stretched during a pedal rotation. This corresponds to a musical tempo of 100 to 160 metronome clicks per min. Some exercising persons prefer rotational frequencies of about 100 pedal rotations per minute (for a short time), too. This corresponds to a music tempo of about 200 (presto), provided that two musical beats each of a quarter note in length are played during a pedal rotation.

According to the results of my research individually different positions of the foot pedals 1B are selected for the onset of an audible beat in a range from about 40 to 170 degrees after the upper vertical position during forward pedalling has been reached.

Some practicing persons like to select the pedal, at which the—often prominent—first and third quarter at 4/4 meter and the first quarter at 2/4 meter, respectively—often being prominent—begins (With 3/4 meter the prominent first quarter changes from one leg to the other).

It is also comfortable for the exercising person to choose between different onset points of the audible beats within a movement cycle during training.

For training with music it has proved to be useful to provide grips 35 for the handle bars 10 which are individually adjustable in respect of the height and the distance from the body. The oblique position of the grips 35—inclined at about 30° to 40° reference to the horizontal—is intended to allow for a middle position of the lower arm between pronation and supination . An adjustment is recommended, which enables a relatively upright posture of the upper body (inclined about 15 to 20 degrees forward with reference to the vertical position) even if one arm is stretched during the forward movement of a handle bar.

A relatively static muscle work of the arms while supporting the weight of the upper body which is leaning forward can usually be observed during movement of the handle bars with the arms bent. This can be largely reduced in the manner described above. Static muscle work leads to muscle fatigue even with small loads as it is connected to continuous muscle contraction.

Figure 5:
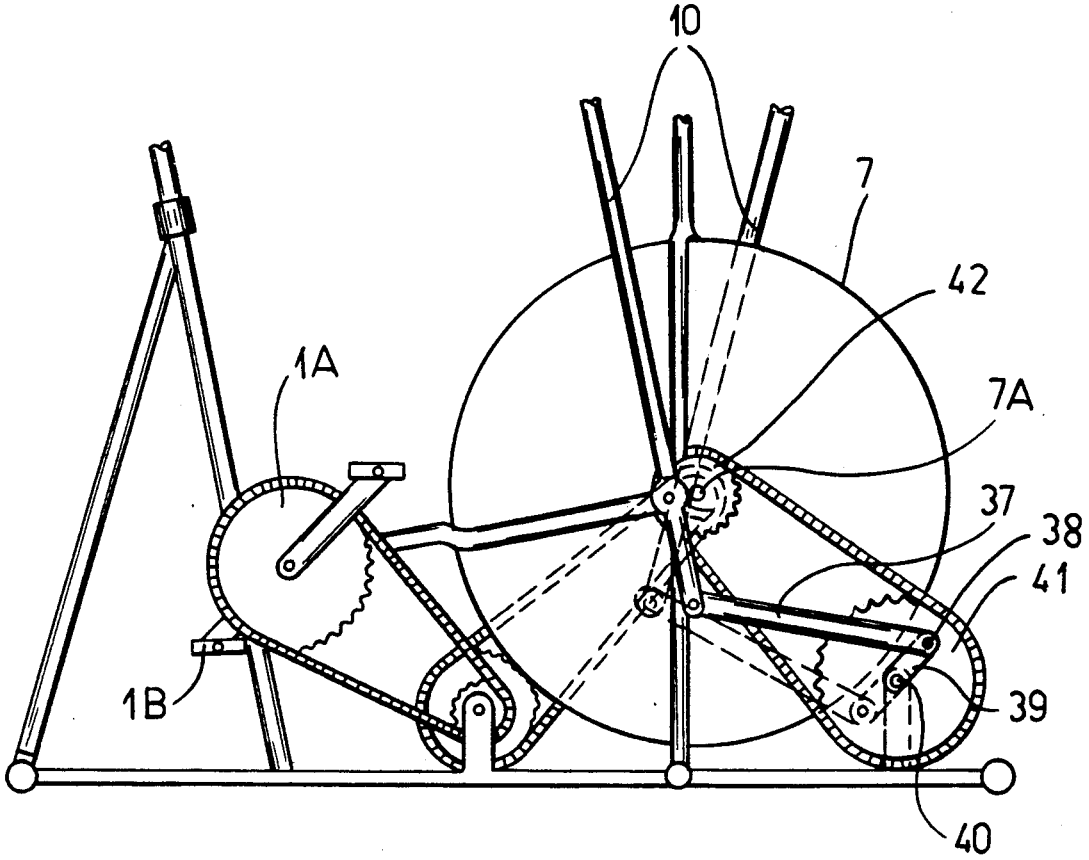
FIG. 5 is a fragmentary elevational view which shows an alternative arrangement of the arm movement device in FIG. 1

Furthermore a forward movement of the handle bars 10 is usually felt to be more pleasant if it directed slightly downwards This can be easy achieved by a pivot for the drive bars 37 at the end of the handle bars which is positioned closer to the foot pedal crank arrangement (correspondingly to German Patent Document2742 719) and by an extension of the handle bars 10 via an adjustment device 35A. An alternative embodiment for the exercise cycle with coordinated movement of the handle bars 10 and foot pedals 1B illustrated in FIG. 1 (c.f. German Patent document 27 42 719) is shown in FIG. 5. It differs from the device of German Patent 517 774, on which it is based, in as much as the driving force stemming from the handle bars 10 transmits the force on to the fly wheel 7 via an additional cogwheel 41—and not via the cog wheel 1A connected to the foot pedals 1B. Thus the drive bars 37 do not move in the area of the foot pedals 1B. The advantage is that the space for the feet to move in is less restricted, safety measures are easier to deal with and a change in the construction of the pedal crank drive unit is not necessary. FIG. 5 shows in detail the following differences in construction from FIG. 1. There is a pivotable connection between the handle bars 10 and the drive bars 37 and between the latter and the pins 38. The pins 38, the crank arms 39 and an axle 40 are secured to each other and with a cog wheel 41 so as to rotate therewith. The cog wheel 41 transmits the movement of the handle bars 10 via a chain in a desired transmission ratio to a cog wheel 42, that is secured to the flywheel 7 or to a freewheel clutch of a flywheel 7 if one is present, so as to rotate therewith. It is preferable to choose the same transmission ratio between cog wheel 41 and cog wheel 42 of the flywheel 7 as between the cogwheels 1A and 7A to ensure the same frequency of movement cycles of the arms and legs. But it may also be pleasant for the user that the frequency of arm movements in comparison to pedal rate can be halved by halving the transmission ratio.

The described adjustability of the handle bars 10, the shifting of their rotation range and the transmission of the movement of the handle bars 10—described above—to the flywheel 7—by means of a device positioned away from the practicing person—are improvement which can also be used in exercising without music.

Figure 3:
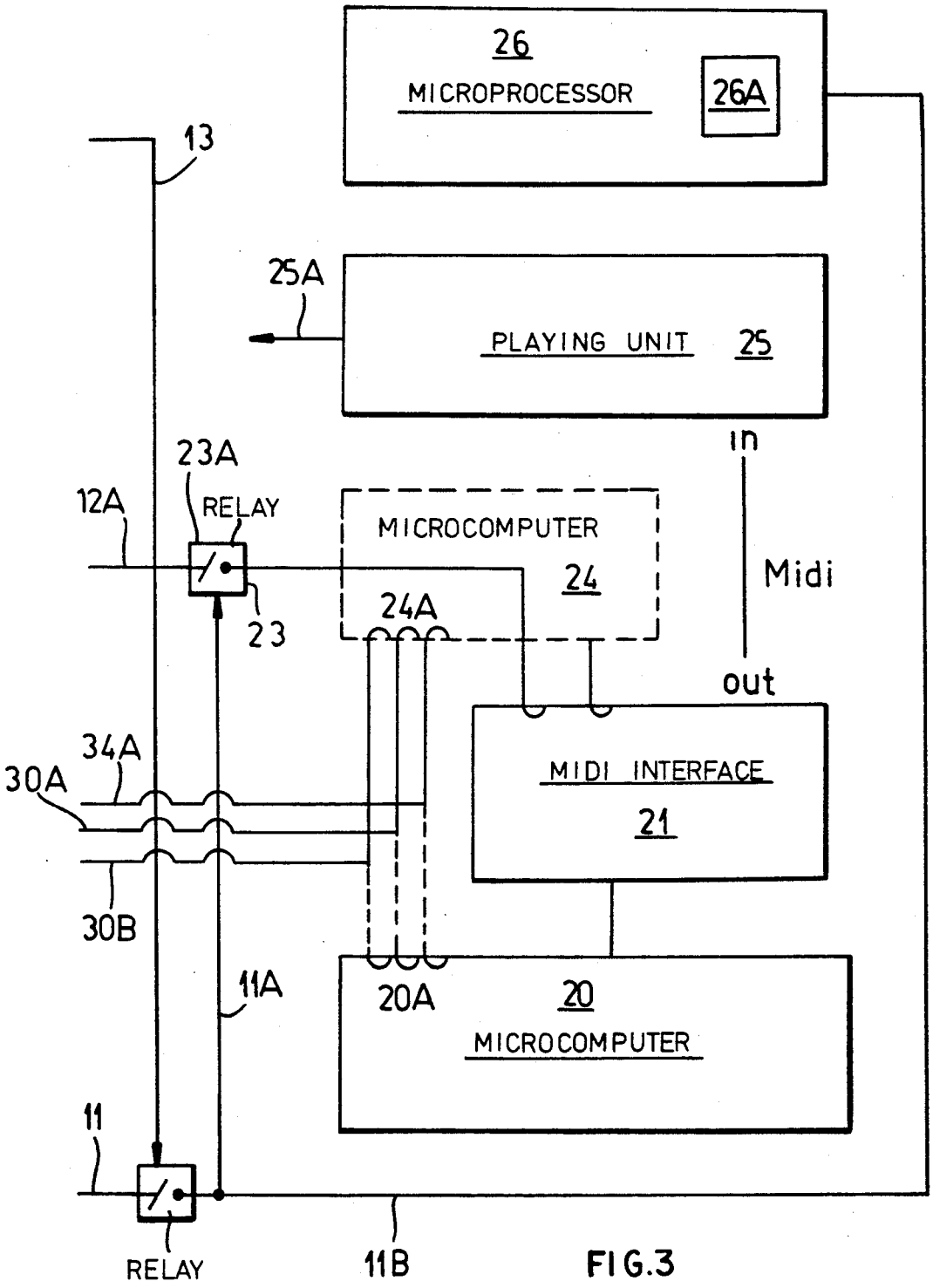
FIG. 3 is a block diagram which illustrates schematically a synchronization and music playing unit.

For the first embodiment we assume that the audible beats begin at the onset of the musical beats. The synchronization of the audible music beats from and to freely selected phases of leg stretching can be simply achieved with the use of standard devices and a sequencer program by means of the so-called external synchronization of the tempo at which the computer stored synthesizer music is played. A synchronization and playing unit capable of performing this function is schematically illustrated in FIG. 3; it comprises a microcomputer 20 (e.g. IBM compatible PC) with sequencer software for the digital storing and playing of music (e.g. sequencer plus MK III, VOYETRA TECHNOLOGIES, Mamaroneck, USA), a MIDI interface 21 (e.g. OP 4001, VOYETRA TECHNOLOGIES, Mamaroneck, USA) with 5 volt clock input 21A for the external synchronization of the music tempo and a playing unit 25 equipped for MIDI code input (e.g. a synthesizer with a rhythm machine or a keyboard). MIDI is the abbreviation for "music instruments digital interface"described in S. Phillip, MIDI Compendium 2, Fränkisch-Crumbach, 1986.

For external synchronization, twelve magnets 5, serving as pulse generators, are mounted on the right side of the fly wheel 7. A sensor 6 fixed—over the circumference 7B—to the frame of the exercise cycle emits the pulses 12 generated by the passing magnet 5 via a lead 12A to the synchronization and playing unit. The transmission between the cog wheel 1A driven by the pedals 1B and the handle bars 10 or the cog wheel 7A mounted on the fly wheel 7 is fourfold. This means that during a half rotation of the cog wheel 1A and the pedals 1B sensor 6 picks up twenty-four magnet pulses and by means of an electric circuit and a voltage supply with a battery (not illustrated in the drawing) emits (at every passing of a magnet) an electrical 5 volt rectangle pulse to a 5 volt clock input 21A of the MIDI interface 21 connected to the microcomputer 20. One can also generate pulses 12 with an optical sensor 29A and pulse windows 28 in the pedal sleeve 1D (see FIG. 4B). The sequencer program and the digitally stored songs are loaded in the main memory and the mode "external synchronization" with twenty-four clock pulses for a quarter note is selected. Thus, (with every electrical pulse) 1/24 of a musical beat is played—including the pertinent breaks. If, for instance, a musical beat—a quarter note long—contains a sound and a break—each the length of an eighth note, the sound begins with the first clock pulse, continues during the following pulses and is finished with the thirteenth pulse.

The first rectangle pulse 12 actuates the MIDI interface (with an integrated microprocessor) to emit one start code and one timing clock code, and for every following pulse only one timing clock code. The MIDI standard lays down 24 timing clock codes for one quarter note.

To determine the onset point of the audible beats the first pulse emitted by sensor 6 to set off the playing of the first musical beat is chosen in such a manner that the first audible beat starts at the desired position during the pressing down of the foot pedal 1B. This can be achieved, for example, by using a magnet 2 mounted on cog wheel 1A as the pulse generator and the matching sensor 3 mounted on the frame of the exercise cycle. They can be located in such a position that after a start/-stop key 9 is pressed, a relay 22 is switched via a lead 13 (FIG. 3) and a first pulse can be transmitted via the leads 11 and 11A, when the right foot pedal has reached the chosen onset position of the musical beats in its movement cycle. This pulse switches a relay 23, which makes a contact 23A for a lead 12A for the synchronization pulses. The playing of the first musical beat begins after the transmission of the first pulse of the magnet 5 via the lead 12A. The start of playing can be changed by moving the position of the magnet 2 in order to allocate the audible beat of a musical beat to the preferred phase of muscle contraction.

It is useful to select a rhythm accompaniment with prominent audible beats to reinforce the favorable effect.

After a further pushing of the start/stop key 9 the next pulse of sensor 3 simultaneously opens the contacts of relays 22 and 23. Stopping the transmission of the rectangle pulses 12 by a pulse of sensor 3—i.e. before the start position—ensures that the playing of the music is stopped at the end of a quarter note. The generation of notes played during the last pulse continues; thus they can still be heard.

Pushing the start/stop key 9 again makes it possible to continue playing the music at the beginning of the next musical beat. Because of the moment of rotation of the flywheel accidental backward pedalling and thus a shifting of the onset position of the musical and audible beats do not usually occur during forward pedalling of the foot pedals without a free wheel even if the movement tempo is changed.

As changes can occur during backward movements of the pedals at the beginning of training or during work-breaks it is not recommended to push the start/-stop key 9 until the forward pedalling has begun and before making a break. If a change of the onset point occurs or is desired by the exercising person, he can interrupt the transmission of the pulses 12 by pushing a button on the panel 9A. Thus, he can shift backwards the pedal position at the onset point of the musical beats by each suppressed pulse 12 for a fourteenth part of the pedal rotation. By another key which emits an additional pulse with each pressing of the key, the onset point can be shifted forward to a later pedal position. switch on the panel 9A can switch to a 5-Volt-rectangular-pulse generator if a constant music tempo independent of the movement is preferred for a limited time This generator can transmit rectangular pulses 12 to the 5-Volt clock-input 21A in the frequency necessary for the preferred music tempo (tempo times two) The frequency can be adjusted by means of a control knob.

The embodiment described above can be realized simply. But it has the disadvantage that the exercising person has to observe the onset point of the audible beats and to push the keys on the panel 9A in order to correct each musical beat deviating from the position of foot pedal IB at a pulse 12 of sensor 3, as well as unintentional shifting of the onset point of the musical beats that occurs when pedalling backwards. This is also the case if there is to be an intentional change of the onset point.

By using the microcomputers 24 or 20 it is possible to start the music playing at the chosen onset point and, at the same time, permits a control of its position to be carried out at each rotation and necessary corrections to be made automatically. Moreover it is possible for the exercising person to make further choices and adjustments as described below. As the microcomputer 24 only has to carry out such controls and corrections a single-board computer is perfectly adequate If the microcomputer 20 has—in addition to the tasks described above—to transmit additionally the timing-clock-codes and note-codes to the playing-unit 25, the use of a personal or home computer with a hard or floppy disc for the digital codes of songs has to be recommended. The microcomputer 24 can correct a shift of the onset-points at every pulse of sensor 3 by calculating whether the ratio of the number of emitted pulses from sensor 3 and 6 equals 1 to 48. In case of deviation the microcomputer could re-establish the ratio by suppressing pulses to the 5 volt clock entry 21A or by transmitting additional pulses (or by a combination of both procedures).

A more flexible correction can be carried out by means of a device which makes it possible to recognize the direction of the pedal rotation by the pulses. Exercise cycles often allow the exercising person to "freewheel".

In this case it is not useful to generate the synchronization pulses (as described above) by pulse generators mounted on the flywheel 7. With the use of a freewheel the beginning of the musical beats and thus of the audible beats (referred to the predetermined phase of the movement cycle) would change during each delay of the pedal rotations—compared to the flywheel rotations.

Therefore the pulses for synchronization should be triggered by pulse generators which are positioned at an imaginary circumference of cog wheel 1A moved by pedal rotation or parallel to the cog wheel. In addition—a standstill, a spontaneous backward pedalling or small forward and backward movements of the pedals can easy occur if a freewheel is used—even during forward pedalling at a higher frequency. Therefore a device for registering the rotational direction of the pedalling is especially useful if a free wheel is used.

Figure 4A:
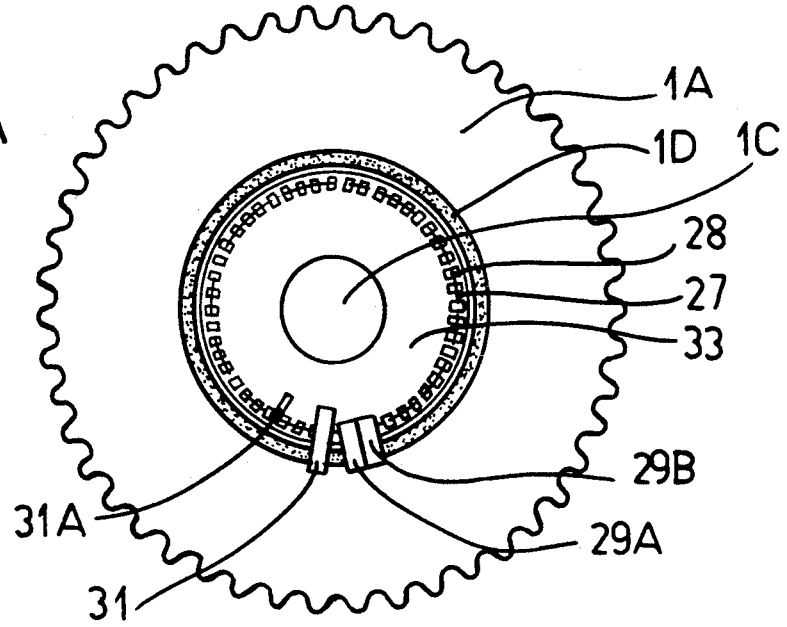
FIG. 4A is an end elevational view of a device for pulse generation and for recognizing the direction of rotation.
Figure 4B:
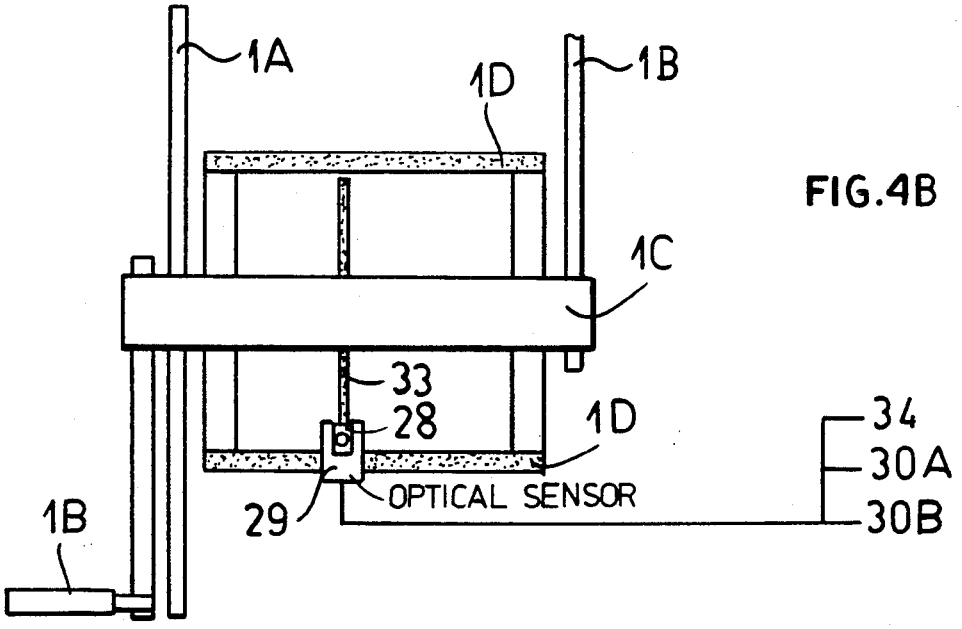
FIG. 4B is a front elevational view thereof.
Figure 4C:
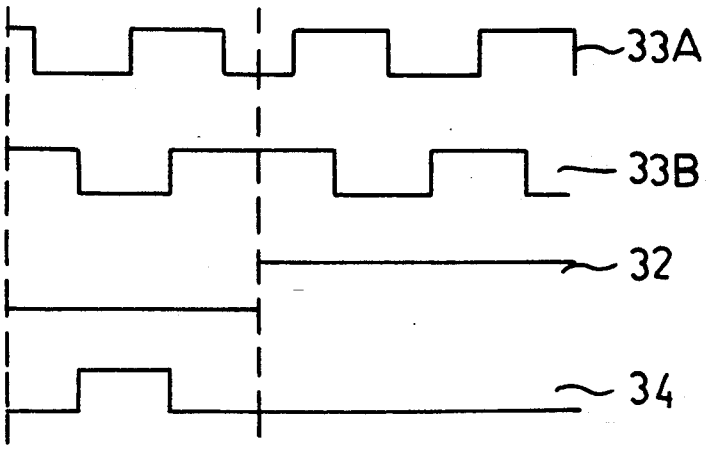
FIG. 4C is a graph applicable to FIGS. 4A and 4B.

To generate 48 rectangular pulses per pedal rotation that recognizes the direction of rotation, a pulse disc 33 with forty eight windows distributed as pulse generators 28 on a circumference 27—equidistant from each other—can be mounted on the axle 1C within the sleeve 1D (see FIG. 4A and 4B). Two slotted optical sensors 29A and 29B (for example OPB980 series, TRW Electronic Components Group, Optoelectronics Division, Carrolton, USA) sunk into the sleeve 1D can scan the windows 28 of the pulse disc 33 and emit two 90° phase shifted pulse series 33A and 33B each with 48 pulses per pedal rotation, via two leads 33A and 33B. The sensors 29A and 29B are so mounted that during forward pedalling the pulses 33A precede the pulses 33B by 90 degrees The microcomputers 24 or 20 are able to recognize the rotational direction by the phase relation. By scanning the window 31A a further optical sensor 31 can transmit a reference pulse 34 at each pedal rotation to the microcomputer 24 or 20 via the lead 34A .

Alternatively one can place twelve pulse generators (for example windows for optical sensors or magnets) on each of two imaginary circumferences of the cog wheel 1A so, that they emit two series of 90 degree phase shifted pulses with a pulse/rest ratio of 1:1. The analysis of the leading and trailing edges makes it possible for a microcomputer to register 48 pulses per rotation and ascertain the rotational direction.

The microcomputer 24 or 20 can receive the pulses 33A, 33B and 34 via the parallel input and carry out controls and automatic corrections of the shifted onset points. The microcomputer 24 (for example a single board computer) can trigger the playing of the music by emitting pulses to the 5-Volt-Clock-input 21B of the MIDI-interface 21 or simpler MIDI—timing clock codes to MIDI-in 21B. The use of microcomputer 20 (for example a PC or home computer) for the input and processing of pulses 33A, 33B and 34 and other inputs described below is more economical, because it can do this work in addition to the emission of MIDI—timing clock codes and note parameter codes for music generation to a music playing unit 25 (synthesizer with rhythm machine). One can also use a synthesizer-card for a PC (e.g. the sound module FB01, Yamaha, Japan). The MIDI-codes necessary for playing a song can be stored after editing or recording by means of a suitable program and loaded in the main memory before the training begins. To process the tasks described below, an assembler program has been developed.

First the onset point of the musical beats and the audible beats respectively within a pedal rotation is selected individually at the beginning of a training session and can be changed during the session by means of the microcomputer 24 or 20, the sensors 29A, 29B, 31 and by adjusting a digital code switch on the panel 9A. One can preselect (for songs in 4/4 and 2/4 time) which leg is being stretched at the first musical beat of a bar.

For the input of the preferred onset point, for example, one can allow the exercising person—via a code switch—a choice of 15 pedal positions. These positions at which corresponding pulses 33A are triggered may be located within a range of between approximately 60 and 165 degrees (after the uppermost position) during forward pedalling. At 48 impulses per pedal rotation it is possible to choose onset points at intervals of (360:48=) 7.5 degrees. The onset position for a musical beat can be selected by code switch and then read from parallel inputs of the microcomputer 24 or 20 at each registration of a reference pulse 31A during forward rotation of the pedals.

As soon as the first pulse from sensor 31 is registered at the same time as an pulse 33A during forward rotation of the pedals (i.e. preceding a pulse 33B by approximately 90 degrees), the microcomputer (program controlled) runs through a series of pulses 33A in uninterrupted succession during the forward rotation, until the position of the selected pedal 1B corresponds to the onset position for the musical beats (one quarter note in length) selected by the exercising person.

The onset position for the next musical beat is then automatically in the corresponding position of the other foot pedal. If in the search for the onset position pulses are registered during backward pedalling, there must follow a corresponding number of pulses during forward pedalling, minus n×48 (n=number of complete rotation during backward pedalling) until the search for the onset point is continued. One can also restart the search for the onset point at the next reference pulse during forward rotation.

If the onset of the audible beats is delayed in relation to the beginning of the musical beats, the exercising person will shift forward the onset point of the musical beats within the movement cycle for a corresponding number of pulses 33A because he orientates himself in accordance with the audible beats.

Once the pedal has arrived at the onset point, the microcomputer 24 transmits—for each pulse 33A registered during forward rotation of the pedals—a MIDI timing clock code (F8(h)) to control the music tempo to microcomputer 20 or microcomputer 20 transmits—in addition to the timing clock codes—codes for note parameters. This is continued as long as no pulses are registered during the backward rotation of pedals 1B. If this is the case a timing clock code (or, additionally note codes) is transmitted after a delay of a corresponding number of pulses minus n×forty-eight (n=number of complete backward rotations). It is possible too, to correct the shifting of the onset point of the musical beats—and thus of the audible beats too—at the next pulse 33A during forward rotation by transmitting additional timing-clock-codes (F8(h)). Their number equals: 48−(pulses during backward pedalling−n×48).

For the additional control of the onset point the transmitted timing clock codes (or corresponding note units) can be added up (after resetting the counter to zero at 48) and after a reference pulse has been registered during forward rotation and corrections completed in the case of backward pedalling it can be checked if the number of timing-clock-codes plus the preset number of pulses 33A during forward rotation up to the onset point equals 48. Should the total exceed 48, no clock codes are to be transmitted for the equivalent number of the succeeding pulses 33A during forward rotation in excess of 48. Should the total be below 48, a number of additional pulses equivalent to the difference has to be transmitted.

During training at each reference pulse during forward pedalling the position of the code switch for the onset position can be read and—except in the course of computer corrections—the controls and corrections described above can be carried out. Thus any necessary corrections resulting from errors and in changes of the selected onset positions can be carried out by means of the same operation An automatic correction (of the onset point) after backward pedalling can also be carried out by a continuation of the playing of the music at the next bar or quarter note at the selected onset point. This procedure is suitable, too, to continue the playing of music after the exercising person has taken a break.

If the playing of the music is manually or automatically continued at the bar in which the music has been stopped or if changes in the synchronization (to an onset position) occur, the microcomputer 24 or 20 has to calculate the position of the bar of the song by a previous addition of all emitted timing-clock-codes . For instance a MIDI-Stop-code can be automatically transmitted at pulses 33A during backward pedalling. To continue playing after renewed forward pedalling the microcomputer 24 can automatically transmit a song-position-pointer-code with two data bytes defining the beginning of the next quarter note or bar via a MIDI-interface to the sequencer program which has been prepared for external synchronization by SPPand MIDI timing clock in chase mode. The microcomputer 24 immediately transmits the Song-Position-Pointer-Code (=F2), the data bytes and the MIDI-continue-code (FB(h) to the sequencer program via the MIDI-interface 21 after the first pulse of sensor 31 has been registered. Then one synchronizing MIDI-timing-clock-code is transmitted to the MIDI-input 21B for each pulse 33A registered by microcomputer 24 during forward pedalling. This continues until a pulse 33A (during backward pedalling) again triggers a MIDI-stop-code. An automatic correction after stop during backward pedalling can be achieved even more quickly by jumping to the smallest unit of the song-position-pointer, corresponding to a sixteenth of a note.

If microcomputer 20 directly registers and analyses the pulses 33A and 33B, it can correspondingly continue the playing by transmitting to the synthesizer 25 timing-clock-codes and note codes for the beginning of the next bar or sixteenth of a note when the next relevant pulse 33A is registered during forward pedalling.

Research shows that exercising persons may like to be able to switch between movement controlled and preset music tempo. The signal of a switch between both operation modes can be transmitted via a parallel input to the microcomputer 24 or 20. After receiving the switch signal for a predetermined music tempo the microcomputer 24 can transmit timing clock codes at a constant frequency, alternatively the microcomputer 2o has to transmit timing clock codes together with note parameter codes. For instance, the preferred constant music tempo can be selected from 15 different tempi via the code switch which is now no longer required for the onset positions Alternatively the tempo can be preset that corresponds to the rotational frequency at switching (rotations per minute times two). Two other keys may be provided to raise or lower the preset tempo, which constantly change the tempo by one metronome click. Should there be a switch from preset to movement controlled music tempo the bar position within the song has to be registered. The playing of the music can be continued at the next bar of the music when the onset point of the musical beats has been reached. In order to avoid frequent corrections after backward pedalling and the playing of music at a very slow tempo, one could automatically switch to a constant music tempo if the pedal rate falls again below a set value and control the music tempo by movement if this value is surpassed.

The pulse from sensor 31 can be used by the microprocessor 26 to calculate the number of current and average revolutions per min and to display the results on a screen 26A, as well as the difference between the total pedal rotations per min and a preset number (German Patent Document 2753041), the pedal position at the beginning of the musical beats and possibly further parameters.

Instead of transmitting note parameter codes to a synthesizer, microcomputer 20 can control the music tempo of digitalized electrical signals of music. This is only possible if the microcomputer 20 can recognize sample sections which, on the basis of musical beats of a quarter note—as in our example—should be the twenty-fourth part of a quarter note, e.g. by special codes at the beginning of the sections. The successive pulses for synchronization could start the playing of each section with a constant tempo.

If the synchronizing pulses accelerate, the sample points allocated to the preceding pulse but not yet played could be skipped. A decelerated pulse succession would lead to small gaps, perhaps bridgeable by repetitions.

The described tempo control of music by an exercise cycle can also be applied to ergometers with a load adjustment independent of the pedal rate. Their usage for controlling the music tempo is advantageous for the rehabilitation of heart patients because a tempo acceleration may be felt as a welcome change variation which is not dangerous as it not does place too high a strain on the heart.

Figure 2:
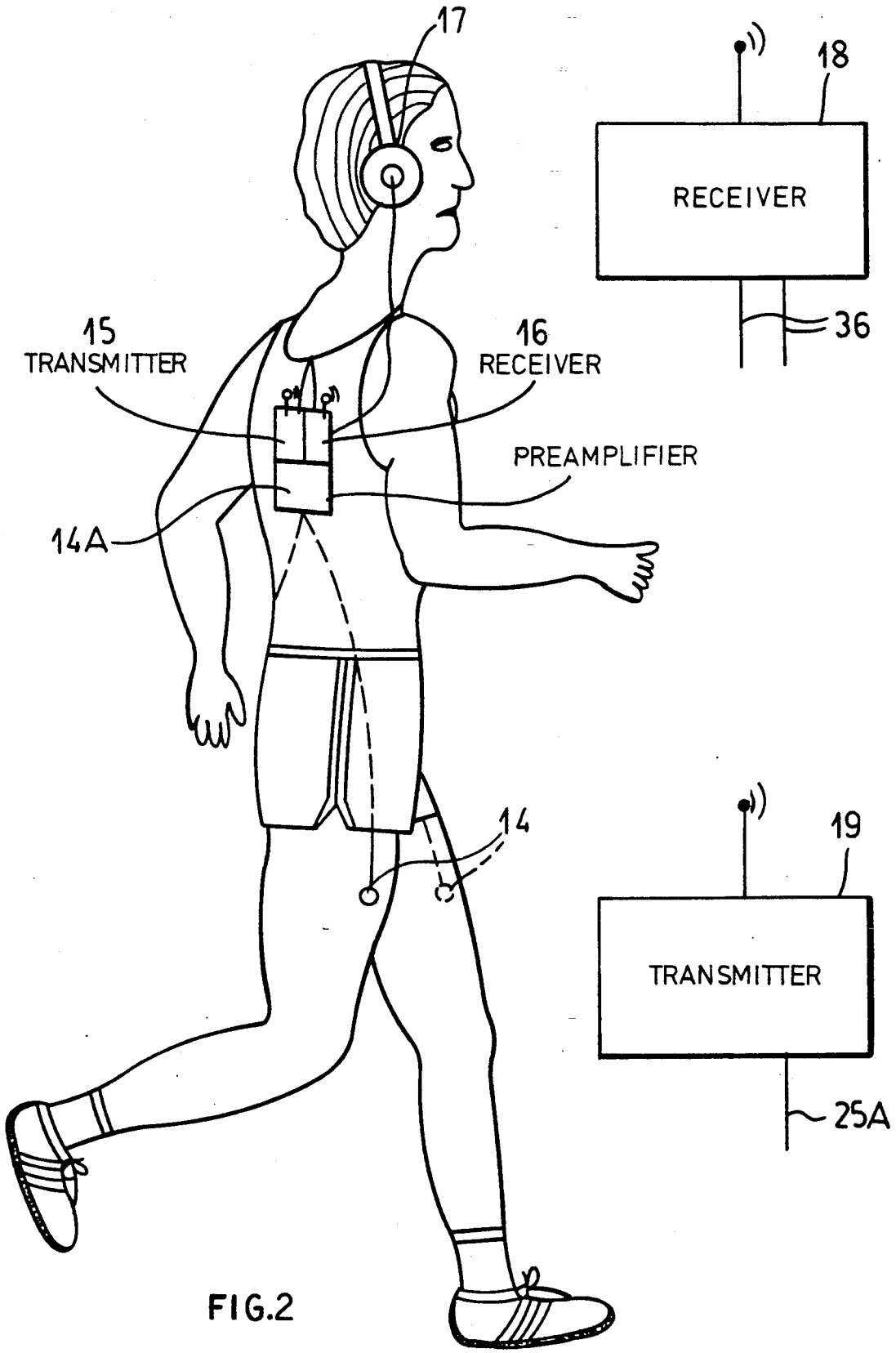
FIG. 2 shows a jogging person which goniometers in a wireless system according to the invention.

In the second example embodiment the synchronization of the music tempo (see FIG. 2) to the leg movements is effected during jogging on a track, from which signals can be telemetrically transmitted to the synchronization- and playing unit.

During the movement cycle of a leg the movement sections cannot be related to a fixed distance as in a pedal rotation. The length of a step may constantly vary a little. But to synchronize the music tempo, one can confine oneself to registering some characteristic points of the movement cycle an use them to estimate the time sections of the ensuing movement cycle. By means of measuring instruments such as two goniometers 14, the rhythmic bending and stretching of each thigh at the hip or the knee can be registered and can be transmitted by a transmitter 15 to a receiver 18 (e.g. the goniometers of Penny & Giles, Blackwood, GB). The output voltage varies in proportion to the bending of the joints. For this embodiment, the synchronization- and playing unit in FIG. 3 can also be used. After analog-digital conversion of the signals arising from the bending movement from goniometers 14 the microcomputer 24 or 20 can ascertain the extreme position during the transition from bending to stretching and then determine an onset point for the musical beats. They can also calculate the time difference to the preceding corresponding upper extreme position or the preceding onset point for the musical beats of the other thigh as a basis for estimating the time difference to the next corresponding position of this leg. The influence of artifacts with higher frequencies (for example as a result of vibration of the measuring device or interfering signals during telemetric transmission) can be reduced by band pass filtering and/or moving averages in real time. In this connection the phase shifting dependent on the filter frequencies or the number of averaged values have to be considered. Artifacts with higher frequencies may also be eliminated by software filtering. For this purpose, the voltage difference of each digitalized voltage value from the preceding value could be compared to a set limit which corresponds to a bending change per time unit which does not occur in jogging. Higher values could be eliminated as artifacts.

To determine the maximal voltage of the goniometers 14 at the maximal bending point, in the hip or knee during jogging the microcomputer 24 or 20 can compare each voltage value after analog-digital conversion and artifact correction with a value which is accepted to be the minimum that has to be attained by bending during jogging. When this value is attained the ensuing measured values can be checked to see if they are increasing. Maximal bending can be accepted, as soon as a voltage is attained that falls short of a preceding peak value by a preset percentage or an absolute amount.

One can also select a fixed distance from the maximal value which is minimally necessary. In addition—one could require a minimal time distance between the values of increasing and decreasing bending at the same voltage distance from the interpositioned value at the maximal bending in order to eliminate artifacts. These should increase with the distance from the maximal bending point and always be achieved during jogging.

As a preset voltage value for accepting a preceding maximal bending a value can be chosen which is also suitable as an onset point for a musical beat. This should be determined individually e.g. possibly by the input of a selected value for a degree of bending as an onset point for the musical beats, corresponding to the procedure in the example embodiment for an exercise cycle. If there is a delay before the audible beats begin within the musical beats, the jogger can choose a correspondingly earlier onset point for the musical beats.

The search for onset points can begin with the signals for one leg (bending) and after success continue with the other leg. A program controlled analysis of a curve section is also suitable for determining parameters. Provided the synchronization and playing unit described above (see FIG. 3) are used and an onset point has been found, twenty-four timing clock codes for playing a musical beat of a quarter note have to be distributed over the estimated time between the last maximal bending (or onset point) and the ensuing corresponding point of the other leg. At the same time as the transmission of the timing clock codes the recognition procedure begins for the maximal bending point of the other leg. Instead of the time difference between the last registered onset point for the musical beat of one leg and the corresponding value for the other leg, an average of the last two or three time differences can be used.

The bending and ensuing stretching phases, not recognized for instance because the leg has not been raised sufficiently or on account of artifacts, would lead to a continued playing of the note which has just been played In order to reduce unpleasant music experiences (for instance when a delay occurs in recognizing the next stretching phase by more than 20% in comparison to the estimated value) one may instead, for example, transmit a series of synchronization codes at equal time intervals, corresponding to the last estimated time difference. The estimated value may also be slightly reduced in order to offset possible drops in the time difference when the step frequency of the other leg is raised. For each timing clock code there is then 1/24 of the reduced estimated time difference. The transmission of the timing clock codes to the synchronization unit or—in case of microcomputer 20 (with note codes)—to the playing unit 25 can be delayed by a set percentage of the time difference if the audible beat is to begin in about the middle of the distance between the maximum point to which the thigh is raised and the point at which the foot touches the ground.

Before the transmission of a timing clock code series begins, a check has to be made to see if the transmission of the preceding series has finished. If this is not the case on account of the leg having been moved forward more quickly, the ensuing series of timing clock codes cannot be transmitted (correspondingly accelerated) until the remaining timing clock codes of the current series have been transmitted with similar acceleration. (The series could also be omitted). The recognition of the upper extreme position and the necessary calculations, controls and preparations for starting a pulse series should take only about a millisecond so that the audible beat can begin shortly after this extreme position, if desired.

The music synchronized to the running rhythm can be radioed by transmitter 19 to a portable receiver 16 with ear phones 17.

During deceleration of the running tempo, breaks at the end of a musical beat (a quarter note long) and notes that have not yet been completed are minimally prolonged These prolongations may be somewhat more increased in case of reduced time estimation. At a pedalling speed of 80 to 90 steps pro min for each leg, i.e. a music tempo of 160 to 180 pro min, this is not felt to be unpleasant. Indeed the prolongations of the breaks may well contribute to stressing the rhythm On the other hand, the deduction in the estimated time difference may be omitted if a fairly constant running tempo is to be expected. The codes not transmitted at the beginning of the next musical beat, as is the case when the running speeds up, and the accelerated playing of the music ar not usually felt to be unpleasant.

In addition, one can calculate the time differences between the opposite extreme positions i.e. the between stretching and bending of each leg at the hip or between other prominent points of the movement cycle, which divide the time difference between the other extreme positions, i.e. between the bending and stretching of each leg in an approximately constant ratio. If one uses this data additionally to estimate time differences and to transmit synchronization pulses, the adaptation of the music tempo to changes of the movement tempo can be slightly improved. By analogy one can apply the procedure described above for instance by using sensors for compressive force in each shoe.

Today a portable version of the synchronization- and playing unit with stored music codes can be assembled at a reasonable cost. The signals from goniometer 14 can be transmitted to a single board computer with an integrated preamplifier and analogue-digital converter and a memory bank for the note codes of songs. The computer can transmit codes for note parameters as described for use with microcomputer 20 (see page ) to a synthesizer module With such a portable device one can control the music tempo not only by jogging but also by walking faster.

Such a portable synchronization- and playing unit with inputs for the pulses of sensors 29A, 29B and 31 instead of an analog-digital converter is a portable version of the one described in the first embodiment for training with an exercise cycle. It can be used on a bicycle to play movement generated music after pulse generators have been mounted in the sleeve 1D of the foot pedal crank arrangement (see FIG. 4B).

The problem in synchronizing music for stationary rowing devices is that the distance covered can vary during forward and backward movement (of the handle bars)—not unlike of the stride length taken during running.

Here one can register the turning points during forward and backward movement as characteristic points, estimate the length of time to be expected before the next turning point on the basis of the time difference to the preceding turning point and proceed as in the example embodiment for jogging.

As (in rowing) a frequency of about 20 to 30 strokes per minute is usual in training, 2 to 3 beats—each of a quarter note -should be distributed over a forward and a backward movement respectively of the exercising person. Thus a music tempo of about 80 to 180 would be attained. In an embodiment of the invention a handle bar—the middle of which is fixed to a wire rope—unrolls the wire from a wheel connected to a brake unit while the body moves backwards on a sliding seat and the arms are pulled towards the upper body. To generate pulses, the device in FIG. 4A and 4B with sensors 29A and 29B, to determine the position and direction of the rotational direction and sensor 31—to emit reference pulse 34 and a pulse disc 33 (here, for example, with 96 windows) can be mounted parallel to the axle of the brakeable flywheel. A window for the reference pulse 34 can be used to determine and control the position of the onset point for musical beats and should be positioned in the middle between the maximum possible point of the forward and backward movement of the handle bar, which position is also passed during little extension of movements.

A microcomputer 24 or 20 can continuously determine the turning point during forward and backward movement from the change of the rotational direction of the pulses from sensor 29A and 29B. From this and from the onset point for the first musical beat selected by the exercising person, the microcomputer can estimate the onset point of e.g. three other musical beats of a movement cycle on the assumption that they are distributed equidistantly over the cycle. The first onset point of the pull phase can be determined by counting the number of pulses 33A and 33B respectively before or after the reference pulse 34. The number of pulses 33A and 33B respectively between the reached extremity points and their distance from the reference point has to be registered and e.g. for two beats per phase (each a quarter note long) to be divided by forty-eight (MIDI timing clock codes per two musical beats for a quarter note). The results show the number of pulses at which a timing clock code has to be transmitted. For example, at 1.5 pulses pro timing clock code at each third pulse a timing clock code F8(h) has to be omitted to maintain the ratio.

It is practical to begin playing the music when during the preceding movement the turning points, the ratio of pulses 30A and 30B respectively to the necessary timing clock codes and the selected onset point for the first musical beat have been registered. There should be a preset onset point It can be determined by the number of the pulses of the sensors 29A and 29B before or after the reference pulse 34 taking into account the rotational direction. It may for instance be twenty pulses away from the reference pulse 34 in the direction of the forward turning point, 40 pulses away from the reference pulse 34. Thus the playing of the first musical beat has to begin with the twenty-second pulse 33A and 33B respectively, during backward movement. Then the timing codes can be transmitted up to the backward turning point in the calculated ratio according to the registered pulses; the pulses and timing codes, that have been received and transmitted respectively, are registered up to the backward turning point and the deviation of the latter from the estimated backward turning point is calculated. According to the difference, the ratio of pulses to timing clock codes up to the next turning point is estimated again taking into account the deviation from the set number of timing codes which has been transmitted at the current turning point. At each turning point the deviation from the estimated number of pulses can be corrected by transmitting additional codes or by omitting codes as in the example embodiment for jogging.

Especially suitable for the procedure has proved for instance the so called disco rhythm and every other kind of music in which the audible beat coincides with the beginning of the musical beat or starts after a regular or periodic delay after the beginning of the musical beat. But songs in which the onset of the audible beats is changed irregularly can also be felt to be pleasant. For songs in three-four time and with waltz rhythm accompaniment two beats can allocated to one pedal rotation in the same way as for 4/4 and 2/4 time. In this case the prominent first musical beat changes from one leg to the other with each rotation

We claim:

1. A fitness training process which comprises the steps of:

(a) causing an exercising person in seated position to actuate a member with repetitive movement cycles;

(b) monitoring said repetitive movement cycles by an exercising person by electrically generating signals over the entire course of each cycle and for an entire course of movement cycles of the exercising person and so that each movement cycle is subdivided into discrete sections;

(c) generating music having beats subdividable into small musical sections;

(d) electrically synchronizing said music with and in response to the movement cycles so that a predetermined number of said sections of each beat of the music accompanies each of the successive movement cycles; and (e) electrically controlling and varying positions within each of said movement cycles at which audible beats of the music begin by controlledly shifting at least one section of each beat to coordinate with a selected section and location in the movement of said member so that a beginning of a beat is assigned to a predetermined position of at least one body part of the exercising person within each movement cycle.

2. The process defined in claim 1 wherein an audible and a musical beat of the music, respectively begins in a predetermined position within each movement cycle of at lest one body part of the exercising person.

3. The process defined in claim 1, further comprising the step of shifting an onset point of an audible musical beat with each movement cycle.

4. The process defined in claim 3 wherein the music is in digital form.

5. The process defined in claim 3 wherein a pitch of sounds of the music is not changed by a varying movement tempo of the person.

6. The process defined in claim 3 wherein each movement cycle of the person is divided into movement sections and a synchronizing pulse is emitted at the beginning or the end of each movement section.

7. The process defined in claim 3 wherein a number of pulses are emitted during one movement cycle and the number of the pulses during a movement cycle is determined in a way that this number leads to a selected number of musical beats per movement cycle.

8. The process defined in claim 7 wherein the number of pulses necessary for playing a musical beat is equally distributed over a time section and no pulses are emitted if the onset point for the next musical beat in relation to the end of this time section is too late, or the remaining pulses are emitted with increased speed if the beginning of the next musical beat appears too early.

9. The process defined in claim 3 wherein the synchronization locates the audible beats to a determined position during a contraction phase of at least one muscle group of the person active in the movement cycle.

10. The process defined in claim 9, further comprising changing the determined position within the contraction phase can be chanted.

11. The process defined in claim 3 wherein the onset point of the audible or musical beats is brought back to a predetermined position upon a change of the onset point on account of the movement direction within a movement cycle or by irregularities of the pulse emission.

* * * * *